United States Patent [19]

Burundukov et al.

[11] 4,237,347

[45] Dec. 2, 1980

[54] ELECTRODYNAMIC TRANSDUCER WITH LONGITUDINALLY MOVING MAGNET

[76] Inventors: Valentin M. Burundukov; Sergei V. Burundukov, both of ulitsa Entuziastov, 14a-14, Chelyabinsk, U.S.S.R.

[21] Appl. No.: 886,549

[22] Filed: Mar. 14, 1978

[51] Int. Cl.[2] ..... H04R 11/08; H04R 11/04

[52] U.S. Cl. ..... 179/100.41 M; 179/100.41 K; 179/114 M

[58] Field of Search ..... 179/100.41 M, 100.41 D, 179/100.41 Z, 114 M, 100.41 K

[56] References Cited

U.S. PATENT DOCUMENTS

| | | | |
|---|---|---|---|
| 1,667,021 | 4/1928 | Williamson | 179/114 M |
| 2,110,153 | 3/1938 | Holst | 179/114 M |
| 2,114,471 | 4/1938 | Keller | 179/100.41 K |
| 2,361,788 | 10/1944 | Neff | 179/100.41 Z |
| 2,639,156 | 5/1953 | Ward | 179/100.41 Z |
| 3,196,216 | 7/1965 | Davis | 179/100.41 D |
| 3,665,123 | 5/1972 | Ikeda | 179/100.41 M |
| 3,798,391 | 3/1974 | Parker | 179/114 M |
| 4,010,334 | 3/1977 | Demeter | 179/114 M |

FOREIGN PATENT DOCUMENTS

| | | | |
|---|---|---|---|
| 2330349 | 1/1975 | Fed. Rep. of Germany | 179/114 M |
| 2625463 | 12/1976 | Fed. Rep. of Germany | 179/100.41 M |
| 833737 | 4/1960 | United Kingdom | 179/114 M |

*Primary Examiner*—John H. Wolff
*Assistant Examiner*—Alan Faber
*Attorney, Agent, or Firm*—Fleit & Jacobson

[57] ABSTRACT

According to the invention, the electrodynamic transducer comprises a coil with a pair of sections wound in opposite directions. Placed inside the coil is a magnet capable of moving in a longitudinal direction. The unlike poles of the magnet are located in different sections of the coil. The magnet is mechanically coupled to an actuator. The stereophonic and monophonic pickup heads and the electrodynamic microphone are built around said electrodynamic transducer.

42 Claims, 16 Drawing Figures

ELECTRODYNAMIC TRANSDUCER WITH LONGITUDINALLY MOVING MAGNET

FIELD OF APPLICATION OF THE INVENTION

The present invention relates to devices for converting mechanical oscillations into electric signals and vice versa, and to devices for reproducing recorded sound by means of a stylus.

The electrodynamic transducer can be used as a converter in sound pickups and microphones, in sensors of diagnostic equipment, in medical equipment and other systems requiring high fidelity of the reproduced signals.

BACKGROUND OF THE INVENTION

Known in the art are electrodynamic transducers (Polytechnical Dictionary, Moscow, 1977, p. 557) used, for example, in electrodynamic microphones and loudspeakers. The known transducers have a coil, a magnet with a magnetic circuit having an external and internal parts with respect to the coil so as to provide a magnetic gap in which the coil moves thus intersecting the magnetic lines of force at right angles. The known electromagnetic transducers feature a low efficiency, rather a complex design of the magnetic system and considerable weight and overall dimensions. Furthermore, these transducers have low internal resistance, therefore, in some cases they require use of a step-up transformer.

The development of modern acoustical and measuring equipment requires the use of electrodynamic transducers having a simple design, high efficiency and a higher internal resistance eliminating distortion of the signals due to the use of step-up or step-down transformers.

The Faraday experiment was used by the inventor for solving the problem. However, the Faraday instrument consisting of a coil, a magnet and a galvanometer in its original form could not be used as a transducer suitable for practical application due to low efficiency, incomplete utilization of the magnetic field of the magnet and a high noise level due to the action of external magnetic fields.

The known electrodynamic transducers with a movable coil were used as a basis for making pickup heads such as the head "SL 15 Q" of the "Ortophon" company (Funk-Techu, 1974, 29, No. p.p. 201–204).

The head "SL 15 Q" has a magnet with a magnetic circuit providing a magnetic gap, in which are located movable coils mechanically coupled to a stylus holder and a stylus and having flexible leads of a thin wire from the stylus holder subject to vibration. The produced e.m.f. of 0.016 mV/cm/sec is fed through a special cable to a step-up transformer where it is increased to 1.5 mV/cm/sec.

The use of a step-up transformer complicates the construction of the head and results in distortion of the electric signal and in a low efficiency. The magnetic circuit producing the magnetic flux whose lines of force from the unlike magnetic poles are closed through the magnetic gap has considerable weight and overall dimensions. A small number of turns of the coil does not allow one to obtain sufficiently high internal resistance for matching with the amplifier input and to provide high sensitivity of the head. The movable coil has unreliable thin leads subject to mechanical vibration. Furthermore, the head is sensitive to external magnetic fields.

The known electrodynamic transducers with a movable coil are used for making microphones of various types and for different applications (cf. M. M. Efrussi "Microphones and their Application", Moscow, "Energia" Publishers, 1974). The electrodynamic microphones have a magnet with a magnetic circuit for producing a magnetic gap, in which a movable coil is placed, said coil being secured to a diaphragm and having leads to be connected to an external electrical circuit.

Owing to the fact that the magnet of the magnetic circuit produces a magnetic flux whose lines of force from the unlike magnetic poles are closed through the magnetic gap it has a complex configuration or consists of several components, features a considerable weight and a complicated mechanical construction. In spite of a considerable mass of the magnetic system, the microphone is subjected to the effect of magnetic fields. The low number of turns in the coil does not allow one to obtain sufficiently high internal resistance. The presence of a movable coil and thin leads liable to oscillations reduces the reliability of the electrical circuit.

An object of the present invention is to increase the efficiency of an electrodynamic transducer.

Another object of the invention is to reduce the weight and overall dimensions of the electrodynamic transducer.

Still another object is to simplify the technological process of making the transducer.

Yet another object is to increase the noise immunity of the transducer from external magnetic fields.

Another object of the invention is to increase the operational reliability of the transducer.

One more object is to increase the efficiency of a pickup head.

Another object is to reduce the weight and overall dimensions of the pickup head.

Still another object is to increase the sensitivity of the pickup head.

An object of the invention is to increase the internal resistance of the pickup head.

Another object of the invention is to increase the reliability of the electrical circuit of the pickup head.

Another object of the invention is to reduce the sensitivity of the pickup head to the effect of external magnetic fields.

Still another object is to reduce the weight and overall dimensions of a microphone.

Yet another object is to simplify the technological process of making the microphone.

The next object is to increase the internal resistance of the microphone.

The other object of the invention is to increase the reliability of the electrical circuit of the microphone.

The essence of the invention consists in that in an electrodynamic transducer converting mechanical oscillations into electric signals and vice versa including a coil with a pair of sections wound in opposite directions, according to the invention, a magnet mechanically coupled to an actuator, is located within the coil with a possibility of longitudinal movement, the unlike magnetic poles being located in the different sections of the coil.

These and other objects are attained due to the fact that in an electrodynamic transducer converting mechanical oscillations into electric signals and vice versa comprising a coil with a pair of sections wound in opposite directions; according to the invention, a magnet mechanically coupled to an actuator is arranged inside the coil and is capable of moving in a longitudinal direction, the unlike poles of said magnet being located in the different sections of said coil.

The objects are also attained due to the fact that in the electrodynamic transducer comprising a coil and a magnet with a magnetic circuit, according to the invention, the coil has a pair of sections wound in opposite directions; the sections are encompassed by a hollow magnetic circuit; a magnet capable of moving in a longitudinal direction is placed inside said coil; the unlike magnetic poles are located in the different sections of the coil.

It is required that the coil has n pairs of sections and the magnet is made of separate parts, in which case the like poles of two adjacent pairs of the magnet are located opposite to each other and occupy the area of one section of the coil.

The above objects are also attained due to the fact that in a stereophonic pickup head, wherein each playback channel includes one transducer converting mechanical oscillations into electric mechanically coupled to a stylus holder and a stylus, according to the invention, the transducer is an electrodynamic transducer comprising a coil with a pair of sections wound in different directions; said coil accommodates a magnet capable of moving in a longitudinal direction and mechanically coupled to said stylus holder, the like poles of said magnet being located in the different sections of said coil.

One embodiment of the present invention includes a stereophonic pickup head comprising in each playback channel one electrodynamic transducer converting mechanical oscillations into electric signals and mechanically coupled to a stylus holder and a stylus, which has a coil with a pair of sections wound in different directions, a hollow magnetic circuit encompassing the coil, and a magnet placed inside the coil with a possibility of longitudinal displacement; the magnet is mechanically coupled to the stylus holder, the unlike poles of the magnet being arranged in the different sections of the coil.

Another embodiment of the invention consists in that it provides a stereophonic pickup head comprising in each playback channel one electrodynamic transducer converting mechanical oscillations into electric signals having a coil with n pairs of sections wound in opposite directions and mechanically coupled to a stylus holder and a magnet made of separate parts, in which case the like poles of the two adjacent parts of the magnet are arranged in opposition to each other and are located in the area of one section of the coil.

Still another embodiment of the invention consists in that it provides a stereophonic pickup head comprising in each playback channel one electrodynamic transducer converting mechanical oscillations into electric signals mechanically coupled to a stylus holder and a stylus and having a coil with n pairs of sections wound in opposite directions, a hollow magnetic circuit encompassing the coil, and a magnet made of separate parts, the like poles of the two adjacent parts of the magnet being arranged in opposition to each other and located in the area of the same section of the coil.

The magnets of each electrodynamic transducer of the stereophonic pickup head can be mounted directly on the stylus holder in the planes intersecting at an angle $\alpha$ equal to the standard recording angle.

It is expedient that in the stereophonic pickup head the magnets of each electrodynamic transducer are arranged at both sides along the length of the stylus pickup from its fixing point.

It is also possible that the magnets of each electrodynamic transducer of the stereophonic pickup head are removed from the stylus pickup through a certain distance and are connected thereto through flexible rods.

In order to improve the quality of reproduction of the recording, each playback channel of the stereophonic pickup head should be provided with an additional transducer whose magnets together with their rods are located in planes intersecting at an angle $\alpha$ equal to the standard recording angle, in which case in each playback channel all the transducers are located at both sides from the longitudinal axis of the stylus holder.

It is expedient that in the stereophonic pickup head the rods are made in the form of a flat band made of a resilient material and twisted along its length.

In order to simplify the technology, the rods are preferably secured on the stylus holder by means of a clamp ring.

The object of the invention is also attained due to the fact that in the monophonic pickup head comprising one transducer for converting mechanical oscillations into electric signals mechanically coupled to a stylus holder and a stylus, according to the invention, the electrodynamic transducer has a coil with one pair of sections wound in different directions accommodating a magnet capable of moving in a longitudinal direction, the unlike poles of said magnet being located in the different sections of the coil.

The invention also includes a monophonic pickup head comprising an electrodynamic transducer converting mechanical oscillations into electric signals mechanically coupled to a stylus holder and a stylus, which has a coil with a pair of sections wound in different directions, a hollow magnetic yoke encompassing the coil and a magnet placed inside the coil with a possibility of longitudinal displacement, in which case the unlike poles of the magnet are located in the different coil sections.

Another embodiment of the invention consists in that it provides a monophonic pickup head comprising an electrodynamic transducer converting mechanical oscillations into electric signals mechanically coupled to a stylus holder and a stylus, a coil with n pairs of sections wound in different directions, and a magnet made of separate parts, in which case the like poles of the two adjacent parts of the magnet are positioned in opposition to each other and are in the area of the same coil section.

In accordance with one embodiment of the invention, the monophonic pickup head comprises an electrodynamic transducer converting mechanical oscillations into electric signals mechanically coupled to a stylus holder and a stylus and having a coil with n pairs of sections wound in opposite directions, a hollow magnetic circuit encompassing the coil, and a magnet made of separate parts, in which case the like poles of the two adjacent parts of the magnet are arranged in opposition and are located in the area of the same coil section.

The object of the present invention is also attained due to the fact that in an electrodynamic microphone comprising a transducer converting mechanical oscillations into electric signals and mechanically coupled to a diaphragm, according to the invention, the transducer is an electrodynamic transducer containing a coil with a pair of sections wound in different directions. Mounted inside the coil is a magnet capable of moving in a longitudinal direction, the unlike poles of the magnet being located in the different coil sections.

According to one embodiment of the invention, the latter includes an electrodynamic microphone comprising an electrodynamic transducer converting mechanical oscillations into electric signals mechanically coupled to a diaphragm. According to the invention, the transducer has a coil with a pair of sections wound in opposite directions, a hollow magnetic yoke encompassing the coil and a magnet placed inside the coil with a possibility of longitudinal displacement, the unlike poles of the magnet being located in different coil sections.

Another embodiment of the invention consists in that the electrodynamic microphone comprises an electrodynamic transducer converting mechanical oscillations into electric signals and mechanically connected to a diaphragm. According to the invention, the transducer comprises a coil with n pairs of sections wound in opposite directions and a magnet made of separate parts, the like poles of the two adjacent parts of the magnet being positioned in opposition to each other and being located in the area of the same coil section.

According to another embodiment of the invention the microphone comprises an electrodynamic transducer converting mechanical oscillations into electric signals and mechanically coupled to a diaphragm. According to the invention, the transducer has a coil with n pairs of sections wound in opposite directions, a hollow magnetic circuit encompassing the coil, and a magnet made of separate parts, the like poles of the two adjacent parts of the magnet being arranged in opposition to each other and located in the area of the same coil section.

The proposed invention makes it possible to increase the efficiency of an electrodynamic transducer, to reduce its weight, to simplify its manufacturing technology, to increase its reliability and magnetic noise immunity. The use of the proposed electrodynamic transducer in pickup and microphone heads makes it possible to increase their efficiency and magnetic noise immunity, to reduce their weight and overall dimensions while increasing the sensitivity of these heads, and to simplify the manufacturing technology of microphones.

BRIEF DESCRIPTION OF THE DRAWINGS

Other objects and advantages of the present invention will be clear from the following detailed description of some embodiments of the invention with reference to the accompanying drawings, in which.

DETAILED DESCRIPTION OF THE INVENTION

Figure 1:
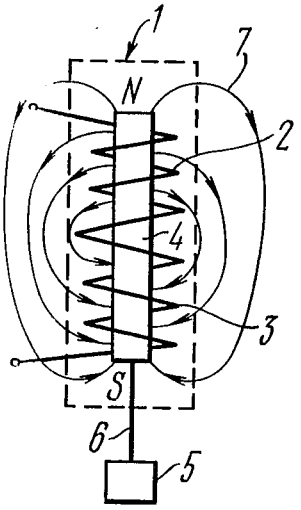
FIG. 1 is a schematic diagram of the electrodynamic transducer according to the invention.

The electrodynamic transducer 1 converting mechanical oscillations into electric signals and vice versa includes a coil of two sections 2,3 (FIG. 1) wound in opposite directions. Installed inside the coil is a magnet 4 whose one pole N is in the area of the section 2, while the pole S in in the area of the section 3. The magnet 4 is connected to an actuator 5 through a rod 6. In this case the actuator 5 is a transmitter or receiver of mechanical oscillations. The drawing shows the lines of force 7 of the magnetic field produced by the magnet 4.

Figure 2:
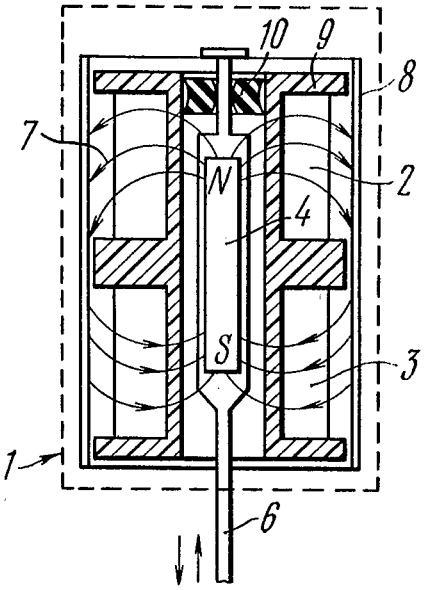
FIG. 2 is a schematic diagram of the electrodynamic transducer with a hollow magnetic circuit, according to the invention.

In order to improve the astatic properties of the system, i.e. to reduce the influence of external magnetic fields, the transducer 1 is provided with a hollow magnetic circuit 8 (FIG. 2) encompassing the framework 9 of the coil. The magnet 4 is centred by means of a washer 10 made of microporous material.

Figure 3:
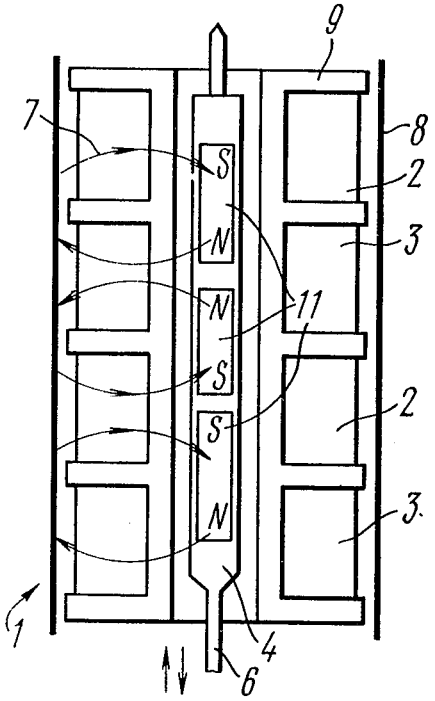
FIG. 3 is a schematic diagram of a small-size electrodynamic transducer, according to the invention.

In order to reduce the size of the transducer 1 and for further improvement of the static properties of the same, the coil is made of n pairs of sections 2, 3 (FIG. 3). Each section 2 or 3 is wound in a direction opposite to that in which are wound its two adjacent sections 3 or 2. In this case the magnet 4 is subdivided into separate parts 11. The like poles N or S of the two adjacent parts 11 of the magnet 4 are arranged in opposition to each other and are located in the area of one section 2 or 3. For example, the poles N are in the area of the sections 2 while the poles S are in the area of the sections 3.

One of the example of utilization of the electrodynamic transducer 1 is its use in heads of stereophonic pickups.

In one design the stereophonic pickup head has two playback channels, each channel being provided with a single electrodynamic transducer 1. The magnets 4 (FIG. 4) of the two playback channels are arranged on a stylus holder 12 at an angle $\alpha$ with respect to each other, said angle being equal to the standard recording angle. Mounted at the same angle $\alpha$ are magnetic circuits 8 accommodating sections 2, 3 of the coil.

A stylus 13 (FIG. 5) is secured in the stylus holder 12, the latter being fixed by means of a damper gasket 14. The magnets 4 are installed on the stylus holder so that they extend through the stylus holder 12 and unlike poles N and S protrude above the surface of the stylus holder 12.

For assembly of the stereophonic pickup head, each section 2,3 (FIG. 6) of the coil has its own framework 15 and 16 respectively, which are drawn apart in the magnetic yoke 8 during the assembly of the head. After the stylus holder 12 has been installed, the frameworks 15 and 16 with the coil sections 2 and 3 return to their initial position which is fixed by a stop 17 preventing the stylus holder from contacting the frameworks 15 and 16.

Figure 7A:
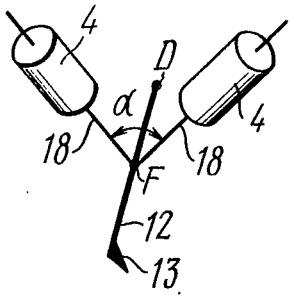
FIG. 7, including *7a–7e*, shows versions of mounting of the electrodynamic transducers on the stylus holder by means of flexible rods, according to the invention.

Another version of the stereophonic pickup head differs in that the magnets 4 (FIG. 7) of the electrodynamic transducer are removed from the stylus holder 12 for a certain distance and are connected therewith through flexible rods 18 in different ways so that the rods 18 are located in planes intersecting at an angle $\alpha$ (FIG. 7*a*). The rods 18 are secured on the stylus holder 12 at points F located between the stylus 13 (FIG. 7*b*) and the points D of fixing the stylus holder 12. Another version provides mounting of the stylus holder 12 at the point D (FIG. 7*c*) occuring between the stylus 13 and the points F of fixing the rods 18. The points F of fixing the rods 18 (FIG. 7*d*) may be located at both sides from the point D of fixing the stylus holder 12. Furthermore, the points F of fixing the rods 18 (FIG. 7*e*) may be located above the point D of fixing the stylus holder 12.

Figure 8:
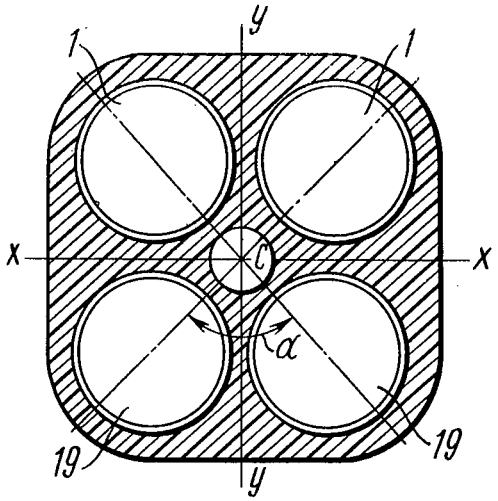
FIG. 8 shows a stereophonic pickup head, in which each playback channel includes two electrodynamic transducers, according to the invention.
Figure 9:
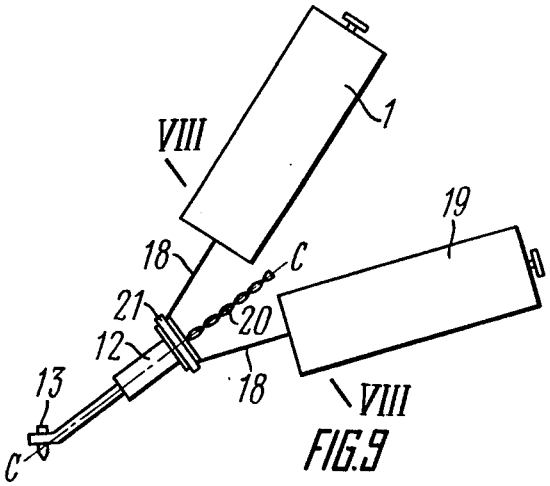
FIG. 9 is a side view of the stereophonic pickup head shown in FIG. 8, according to the invention.

In a stereophonic pickup head of another design each playback channel has an additional electrodynamic transducer 19 (FIG. 8). In each playback channel the transducers 1 and 19 are located in the same plane extending through the longitudinal axis CC (FIG. 9) of the stylus holder 12.

The stylus holder 12 is secured to the housing (not shown) by means of a flat band 20 made of a resilient material and twisted along its length. The rods 18 are also made in the form of a flat band twisted along its length. The rods 18 are secured on the stylus holder 12 by means of a clamp ring 21.

Figure 10:
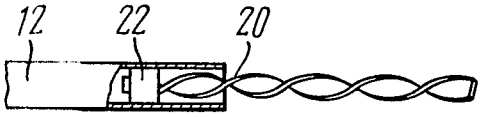
FIG. 10 is a general view of the rods for securing the magnet and stylus holder, according to the invention.

The flat band 20, which is used for securing the stylus holder 12 to the housing, is fixed in the stylus holder 12 by means of a sleeve 22 (FIG. 10).

Figure 11:
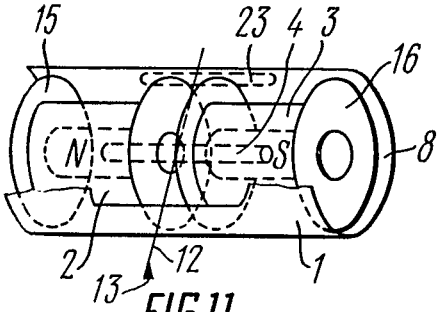
FIG. 11 is a schematic diagram of the monophonic pickup head, according to the invention.

In the monophonic pickup head, in which the proposed electrodynamic transducer 1 is used (FIG. 11), the magnet 4 is secured directly to the stylus holder 12 with a stylus 13. The pole N of the magnet 4 is in the area of the coil section 2, while the pole S is in the area of the coil section 3. The frameworks 15 and 16 of the coil sections 2 and 3 are mounted in the magnetic circuit 8 having openings 23 for mounting the stylus holder 12 with the magnet 4.

Figure 12:
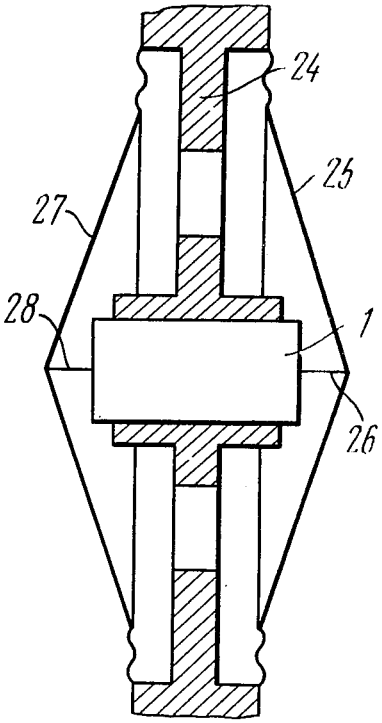
FIG. 12 is a schematic diagram of a microphone based on the electrodynamic transducer according to the invention.

Another example of application of the electrodynamic transducer 1 (FIG. 12) is its use in microphones. The transducer 1 is secured in a housing 24 of a microphone. Secured to one pole of the magnet of the transducer 1 through a rod 26 is a diaphragm 25, while a centring element 27 is secured to the other pole of the magnet through a rod 28. The centring element 27 can be used as a diaphragm.

The electrodynamic transducer operates as follows. The magnet 4 is moved along the longitudinal axis of the coil at the expense of the energy of mechanical oscillations transmitted to the transducer 1 (FIG. 1) through the rod 6 from the actuator 5, which in this case is a source of mechanical oscillations. An e.m.f. is induced in the sections 2,3 of the coil. The magnetic lines of force 7 piercing the turns of the section 2 near the pole N go outwards, while the lines of force near the pole S pierce the turns of the section 3 inwards.

Since the sections 2 and 3 are wound in different directions, the e.m.f. induced therein are added, while the magnetic flux is not changed. This provides operation of the device as an electrodynamic system. External magnetic fields crossing the turns of the sections 2, 3 induce a noise e.m.f. However, these e.m.f. are mutually cancelled thus providing the astatic operation of the transducer.

The presence of a great number of turns in the coils makes it possible to obtain a considerable e.m.f. commensurable with the e.m.f. of ordinary magnitoelectric transducers. This, as well as a high internal resistance of the proposed transducer, makes it possible to eliminate the use of a transformer in the electrical circuit thus increasing the efficiency of the transducer 1.

Since the coil is stationary and has no movable leads, the reliability of the transducer 1 is increased.

A high factor of utilization of the magnetic lines of force 7 allows the magnetic system to be less heavy and of lower dimensions.

The manufacturing technology of the transducer 1 is simplified due to a decrease in the number of components and their simpler configuration.

The use of the hollow external magnetic circuit 8 (FIG. 2) makes it possible to change the direction of the lines of force 7 by directing the majority of them through the turns of the sections 2,3, thus increasing the efficiency of the transducer 1. Furthermore, the magnetic circuit 8 attenuates the external magnetic fields in the transducer.

In order to reduce the overall dimensions of the transducer 1, particularly its transverse size, the coil is made multisectional, while the magnet 4 (FIG. 3) is separated into several parts 11. In this case the coupling between all sections 2,3 rises up and this improves the astatic properties of the transducer 1.

Furthermore, such a transducer 1 can be used for conversion of electric signals into high-power mechanical oscillation with high efficiency of the conversion.

Figure 4:
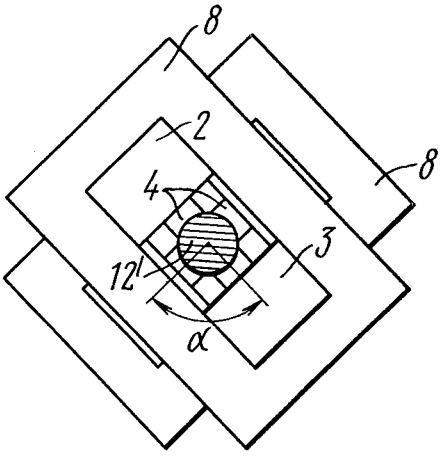
FIG. 4 is a general view of the coil with a stylus holder of the pickup head, according to the invention.
Figure 5:
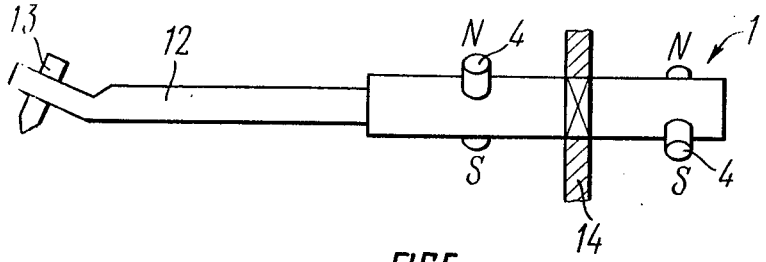
FIG. 5 shows arrangement of the magnets in the head of a stereophonic pickup mounted directly on the stylus holder, according to the invention.
Figure 6:
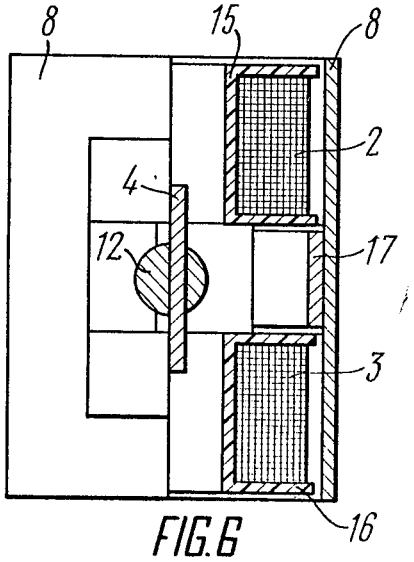
FIG. 6 shows a construction of the stereophonic pickup head, in which the magnets are secured directly on the stylus holder, according to the invention.

The use of the electrodynamic transducer 1 according to the present invention can be effected in various design versions. On of them is shown in FIGS. 4,5,6. The head has two playback channels, each of which is provided with one electrodynamic transducer 1. Since the magnets 4 (FIG. 5) of the transducers are separated from each other, the magnetic coupling between the channels is eliminated. The dynamic properties of the stylus holder 12 are also improved, since the magnets 4 are located at both sides from the damping gasket 14. The heads of this type are light and compact but the coils in them have a limited size and require a fine winding wire.

Another version of the head with a larger size of coils for winding a wire of a larger diameter differs from the above-described device in that the magnets 4 (FIG. 7*a*) are secured through the rods 18. The rods 18 made of a flat band twisted alont its length damp the lateral vibration of the stylus holder 12 and transmit to the magnets 4 only longitudinal oscillations.

Figure 7B:
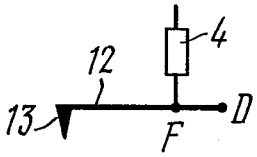
Figure 7C:
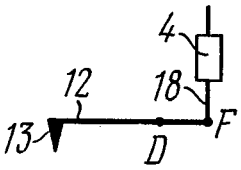
Figure 7D:
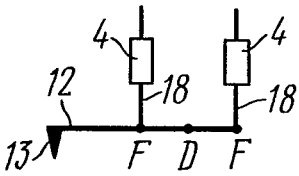
Figure 7E:
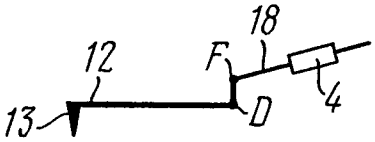

The mounting of the rods 18 shown in FIGS. 7*b,c* is characterized by a simple design, while the mounting shown in FIG. 7*d* improves the dynamic properties. The mounting of the rods 18 (FIG. 7*e*) on the projections of the stylus holder 12 improves the kinematics and transfers the motion to the magnets 4 without lateral deflections.

The use of two electrodynamic transducers 1, 19 (FIG. 8) in each playback channel increases the noise immunity of the head to the longitudinal oscillations of the pickup arm.

In the microphone the electrodynamic diaphragm 25 (FIG. 11) transmits the oscillations to the transducer 1.

The centring element can play a role of an additional diaphragm depending on its area and rigidity.

A model of a sterephonic head provided with two transducers 1, 19 (FIG. 8) in each playback channel is characterized by the following data:

| | |
|---|---|
| head weight | 3.2 g |
| overall dimensions | 25 × 10 × 10 mm |
| frequency response | 20 t0 20,000 Hz or higher |
| sensitivity | 0.71 and 0.76 mV/cm/sec |
| magnetic shield | not used |

What is claimed is:

1. An electrodynamic transducer converting mechanical oscillations into electric signals and vice versa, comprising:

(a) a coil having n pairs of sections, the members of each pair being wound in opposite directions;

(b) a magnet subdivided into separate parts and being placed into said coil and arranged for movement in a longitudinal direction;

(c) like poles of two adjacent ones of said separate parts of said magnet being arranged facing each other, said like poles being located in one of said members of said pairs of said sections of said coil; and (d) an actuator mechanically coupled to said magnet.

2. An electrodynamic transducer as claimed in claim 1, in which a hollow magnetic circuit is provided, said magnetic circuit encompassing said coil.

3. A stereophonic pickup head comprising:

(a) two playback channels; a first electrodynamic transducer converting mechanical oscillations into electric signals for each said playback channel;

(b) a coil of each said first electrodynamic transducer having a pair of sections the members of said pair being wound in opposite directions;

(c) a magnet of each said electrodynamic transducer subdivided into separate parts and being mounted inside said coil and being arranged for longitudinal displacement therein: like poles of two adjacent ones of said separate parts of said magnet being arranged facing each other; said like poles arranged in one of said members of said pair of sections of said coils; and (d) a stylus holder having a stylus secured therein;

(e) said magnet of each said first electrodynamic transducer being mechanically coupled to said stylus holder.

4. A stereophonic pickup head as claimed in claim 3, in which said magnet of each said first electrodynamic transducer is mounted directly on said stylus holder in planes intersecting at an angle $\alpha$ equal to the standard recording angle.

5. A stereophonic pickup head as claimed in claim 4, in which said magnets of each said first electrodynamic transducer of said two playback channels are located at both sides from said stylus holder along its length from the mounting point.

6. A stereophonic pickup head as claimed in claim 3, which has flexible rods, while said magnet of each said first electrodynamic transducer is removed from said stylus holder for some distance and is connected thereto through one of said flexible rods.

7. A stereophonic pickup head as claimed in claim 6, in which each of said two playback channels has a second electrodynamic transducer converting mechanical oscillations into electric signals comprising a coil with a pair of sections wound in opposite directions and a magnet placed inside said coil and being arranged for movement in the longitudinal direction and mechanically coupled to said stylus holder through one of said rods; said magnets of said second electrodynamic transducer of said two playback channels and their rods located in planes intersecting at an angle $\alpha$ equal to the standard recording angle; in each said playback channel said first and second electrodynamic transducers are located at both sides from the longitudinal axis of said stylus holder.

8. A stereophonic pickup head as claimed in claim 7, in which said rods are made in the form of a flat bands of a resisilient material, said band being twisted along its length.

9. A stereophonic sound pickup head as claimed in claim 7, in which said rods are secured on said stylus holder by means of a clamp ring.

10. A stereophonic pickup head as claimed in claim 6, in which said rods are made in the form of a flat band of a resilient material, said band being twisted along its length.

11. A stereophonic pickup head as claimed in claim 6, in which said rods are secured on said stylus holder by means of a clamp ring.

12. A stereophonic pickup head comprising:

(a) two playback channels; a first electrodynamic transducer converting mechanical oscillations into electric signals in each said playback channel;

(b) a coil of each said first electrodynamic transducer having n pairs of sections the members of each pair being wound in opposite directions;

(c) a hollow magnetic circuit of said first electrodynamic transducer encompassing said coil;

(d) a magnet of each said first electrodynamic transducer subdivided into separate parts and being arranged inside said coil for longitudinal movement; like poles of two adjacent ones of said separate parts of said magnet being arranged facing each other said like poles arranged in one of said members of said pairs of said sections of said coil;

(e) a stylus holder having a stylus secured therein;

(f) said magnet mechanically coupled to said stylus holder.

13. A stereophonic pickup head as claimed in claim 12, in which said magnet of each said first electrodynamic transducer is mounted directly on said stylus holder in planes intersecting at an angle $\alpha$ equal to the standard recording angle.

14. A stereophonic pickup head as claimed in claim 13, in which said magnets of each said first electrodynamic transducer of said two playback channels are located in both sides from said stylus holder along its length from the mounting point.

15. A stereophonic pickup head as claimed in claim 12, which has flexible rods, while said magnet of each said first electrodynamic transducer is removed from said stylus holder for some distance and is connected therein through one of said flexible rods.

16. A stereophonic pickup head as claimed in claim 15, in which each of said two playback channels has a second electrodynamic transducer converting mechanical oscillations into electric signals comprising a coil having a pair of sections wound in opposite directions and a magnet placed inside said coil and being arranged for longitudinal movement therein and mechanically coupled to said stylus holder through one of said rods;

said magnets of said second electrodynamic transducer of said two playback channels and their said rods are located in planes intersecting at an angle $\alpha$ equal to the standard recording angle; in each said playback channel said first and second electrodynamic transducers are located in both sides from the longitudinal axis of said stylus holder.

17. A stereophonic pickup head as claimed in claim 16, in which said rods are made in the form of a flat band of a resilient material, said band being twisted along its length.

18. A stereophonic pickup head as claimed in claim 16, in which said rods are secured on said stylus by means of a clamp ring.

19. A stereophonic pickup head as claimed in claim 15, in which said rods are made in the form of a band of a resilient material, said band being twisted along its length.

20. A stereophonic pickup head as claimed in claim 15, in which said rods are secured on said stylus holder by means of a clamp ring.

21. A stereophonic pickup head comprising:

(a) two playback channels; each having a first electrodynamic transducer for converting mechanical oscillations into electric signals in the respective playback channel;

(b) a coil of each said first electrodynamic transducer having n pairs of sections wound in opposite directions;

(c) a magnet of each said first electrodynamic transducer placed inside said coil and being arranged for longitudinal movement; said magnet being formed in separate parts; like poles of two adjacent ones of said separate parts of said magnet arranged facing each other and occurring in the area of said one section of said coil;

(d) a stylus holder having a stylus secured therein, each of said electrodynamic transducers being located at a distance from said stylus holder; and (e) two flexible rods, whereby each of said magnets is mechanically coupled to said stylus holder.

22. A stereophonic pickup head as claimed in claim 21, in which each said magnet of each said first electrodynamic transducer is mounted in planes intersecting at an angle $\alpha$ equal to the standard recording angle.

23. A stereophonic pickup head as claimed in claim 22, in which said magnets of each said first electromagnetic transducer of said two playback channels are arranged at both sides of said stylus holder along its length from the mounting point.

24. A stereophonic pickup head as claimed in claim 21, in which each of said two playback channels has a second electrodynamic transducer, converting mechanical oscillations into electric signals, comprising a coil with a pair of sections wound in opposite directions and a magnet placed inside said coil and being arranged for longitudinal movement therein and mechanically coupled to said stylus holder by means of one of said rods; said magnets of said second electrodynamic transducer of said two playback channels and said rods located in planes intersecting at an angle $\alpha$ equal to the standard recording angle, while in each said playback channel said first and second electrodynamic transducers are located at both sides from the longitudinal axis of said stylus holder.

25. A stereophonic pickup head as claimed in claim 24, in which said rods are made in the form of a flat band of a resilient material, said band being twisted along its length.

26. A stereophonic pickup head as claimed in claim 24, in which said rods are secured on said stylus holder by means of a clamp ring.

27. A stereophonic pickup head as claimed in claim 21, in which said rods are made in the form of a flat band of a resilient material twisted along its length.

28. A stereophonic sound pickup head as claimed in claim 21, in which said rods are secured on said stylus holder by means of a clamp ring.

29. A stereophonic pickup head, comprising:

(a) two playback channels; a first electrodynamic transducer converting mechanical oscillations into electric signals in each said playback channel;

(b) a coil of each said first electrodynamic transducer having n pairs of sections wound in opposite directions;

(c) a hollow magnetic circuit of said first electrodynamic transducer encompassing said coil;

(d) a magnet of each said first electrodynamic transducer placed inside said coil being arranged for longitudinal movement therein; said magnet being formed of separate parts; the like poles of two adjacent said parts of said magnet arranged facing each other and positioned in the area of said one section of said coil;

(e) a stylus holder having a stylus secured therein; and (f) said magnet mechanically coupled to said stylus holder.

30. A stereophonic pickup head as claimed in claim 29, in which said magnet of each said first electrodynamic transducer is mounted directly on said stylus holder in planes intersecting at an angle $\alpha$ equal to the standard recording angle.

31. A stereophonic pickup head as claimed in claim 30, in which said magnets of each said first electrodynamic transducer of said two playback channel are arranged at both sides of said stylus holder along its length from the mounting point.

32. A stereophonic pickup head as claimed in claim 29 which has flexible rods, while said magnet of each said first electrodynamic transducer removed from said stylus holder for some distance and is connected thereto through one of said flexible rods.

33. A stereophonic pickup head as claimed in claim 32, in which each of said two playback channel has a second electrodynamic transducer converting mechanical oscillations into electric signals, comprising a coil having a pair of sections wound in opposite directions and a magnet placed inside said coil and being arranged for movement in a longitudinal direction and mechanically coupled to said stylus holder by means of one of said rods; said magnets of said second electrodynamic transducer of said two playback channels and their rods arranged in planes intersecting at an angle $\alpha$ equal to the standard recording angle, while in each said playback channel said first and second electrodynamic transducers are located at both sides from the longitudinal axis of said stylus holder.

34. A stereophonic pickup head as claimed in claim 33, in which said rods are made in the form of a flat band of a resilient material, said band being twisted along its length.

35. A stereophonic pickup head as claimed in claim 33, in which said rods are secured on said stylus holder by means of a clamp ring.

36. A stereophonic pickup head as claimed in claim 32, in which said rods are made in the form of a flat band of a resilient material twisted along its length.

37. A stereophonic pickup head as claimed in claim 32, in which said rods are secured on said stylus holder by means of a clamp ring.

38. A monophonic pickup head comprising:

(a) an electrodynamic transducer converting mechanical oscillations into electric signals;

(b) a coil of said electrodynamic transducer having a pair of sections wound in opposite directions;

(c) a magnet of said electrodynamic transducer divided into separate parts and being placed inside said coil and being arranged for longitudinal movement therein; like poles of two adjacent ones of said separate parts of said magnet being arranged facing each other; said like poles being arranged in one of said sections of said coil;

(d) a hollow magnetic circuit of said electrodynamic transducer encompassing said coil;

(e) a stylus holder having a stylus secured therein;

(f) said magnet mechanically coupled to said stylus holder.

39. A monophonic pickup head comprising:

(a) an electrodynamic transducer converting mechanical oscillations into electric signals;

(b) a coil of said electrodynamic transducer having n pairs of sections wound in opposite directions;

(c) a magnet of said electrodynamic transducer arranged inside said coil longitudinal movement therein; said magnet being formed of separate parts; like poles of two adjacent ones of said parts of said magnet arranged facing each other and located in the area of said one section of said coil;

(d) a hollow magnetic circuit of said electrodynamic transducer encompassing said coil;

(e) a stylus holder having a stylus secured therein;

(f) said magnet mechanically coupled to said stylus holer.

40. An electrodynamic microphone comprising:

(a) an electrodynamic transducer converting mechanical oscillations into electric signals;

(b) a coil of said electrodynamic transducer having n pairs of sections wound in opposite directions;

(c) a magnet of said electrodynamic transducer formed of separate parts and arranged inside said coil for longitudinal movement therein; like poles of two adjacent ones of said parts of said magnet arranged facing each other and located in the area of said one section of said coil;

(d) a diaphragm mechanically coupled to one of said unlike poles of said magnet;

(e) a centering element mechanically coupled to the other unlike pole of said magnet.

41. An electrodynamic microphone comprising:

(a) an electrodynamic transducer converting mechanical oscillations into electric signals;

(b) a coil of said electrodynamic transducer having a pair of sections wound in opposite directions;

(c) a magnet of said electrodynamic transducer formed of separate parts and being arranged inside said coil for longitudinal movement therein; said separate parts of said like poles arranged facing each other in one of said sections of said coil;

(d) a hollow magnetic circuit of said electrodynamic transducer encompassing said coil;

(c) a diaphragm mechanically coupled to one of said like poles of said magnet; and (f) a centering element mechanically coupled to the other like pole of said magnet.

42. An electrodynamic microphone comprising:

(a) an electrodynamic transducer converting mechanical oscillations into electric signals;

(b) a coil of said electrodynamic transducer having n pairs of sections wound in opposite directions;

(c) a magnet of said electrodynamic transducer formed of separate parts and arranged inside said coil for longitudinal movement therein; each of said separate parts of said magnet having unlike poles; like poles of the two adjacent parts of said magnet arranged facing each other and located in the area of one of the members of one of said pairs of said coil;

(d) a hollow magnetic circuit of said electrodynamic transducer encompassing said coil;

(e) a diaphragm mechanically coupled to one of said unlike poles of said magnet; and (f) a centering element mechanically coupled to the other unlike pole of said magnet.

* * * * *